US011912490B2

(12) United States Patent
Shelton

(10) Patent No.: US 11,912,490 B2
(45) Date of Patent: Feb. 27, 2024

(54) INSULATED BEVERAGE CONTAINER SLEEVE

(71) Applicant: Howard Shelton, Las Vegas, NV (US)

(72) Inventor: Howard Shelton, Las Vegas, NV (US)

( * ) Notice: Subject to any disclaimer, the term of this patent is extended or adjusted under 35 U.S.C. 154(b) by 0 days.

(21) Appl. No.: 17/868,794

(22) Filed: Jul. 20, 2022

(65) Prior Publication Data

US 2024/0025625 A1 Jan. 25, 2024

(51) Int. Cl.
*A47G 19/22* (2006.01)
*B65D 81/38* (2006.01)

(52) U.S. Cl.
CPC ..... *B65D 81/3876* (2013.01); *A47G 2200/08* (2013.01)

(58) Field of Classification Search
CPC ..... F21V 23/0414; B65D 81/3876; B65D 2203/12; B65D 2203/00; A47G 19/2227; A47G 19/025; A47G 2019/2238; A47G 23/0306; A47G 2200/08
USPC ..... 362/101, 154, 89; 220/739, 737, 592.16, 220/592.17, 592.2, 592.24
See application file for complete search history.

(56) References Cited

U.S. PATENT DOCUMENTS 5,221,016 A * 6/1993 Karpal ..... B29C 63/18 215/229
5,551,592 A * 9/1996 Barton ..... B65D 81/3886 220/571
7,098,887 B2 * 8/2006 Rezania ..... G09G 3/00 345/204
10,469,927 B1 * 11/2019 Scott ..... H04R 1/028
2005/0224504 A1 * 10/2005 Killoren ..... B65D 81/3886 220/737
2007/0227913 A1 * 10/2007 Shoenfeld ..... E05B 63/24 206/1.5
2008/0093370 A1 * 4/2008 Darsey ..... B65D 81/3876 220/739
2009/0114550 A1 * 5/2009 Ying ..... A45C 15/00 206/5
2010/0182518 A1 * 7/2010 Kirmse ..... A47G 19/2227 348/836
2011/0259889 A1 * 10/2011 Yang ..... B65D 25/325 220/315
2013/0098549 A1 * 4/2013 Drage ..... C09J 7/30 156/308.6
2015/0136629 A1 * 5/2015 Wu ..... A47G 19/2227 206/459.1
2018/0220820 A1 * 8/2018 Shelton ..... A47G 23/0241
2018/0310766 A1 * 11/2018 Lapsker ..... A47J 41/0061
2021/0000273 A1 * 1/2021 Jesseph ..... B65D 81/3876

* cited by examiner

*Primary Examiner* — King M Chu
(74) *Attorney, Agent, or Firm* — Invention To Patent Services; Alex Hobson

(57) ABSTRACT

An insulated beverage container sleeve; the insulated beverage container sleeve includes an insulated sleeve having a generally cylindrical profile which is configured to receive and host a beverage container within an inner volume. The insulated sleeve is defined by a base, a sidewall, an open top end, and at least one flexible display screen configured to illuminate and display functional indicia. The insulated sleeve includes a thermally insulating material for maintaining a temperature of a beverage contained within a hosted the beverage container.

1 Claim, 6 Drawing Sheets

INSULATED BEVERAGE CONTAINER SLEEVE

CROSS-REFERENCE TO RELATED APPLICATION(S)

The present application is related to and claims priority to U.S. Provisional Patent Application No. 63/361,296 filed Dec. 13, 2021, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of beverage container sleeves of existing art and more specifically relates to an insulated beverage container sleeve.

RELATED ART

Many insulating beverage holders are used today to keep beverages cool. Sometimes referred to as a "koozie," the purpose of these insulating beverage holders is to keep the consumer's hand warm while keeping the beverage cold at the same time. Many types of beverage holders are typically fabricated with a thermally insulating material such as plain foam, neoprene, polyester, and open or closed cell foams. Beverage holders are commonly sized to accommodate a standard twelve-ounce aluminum can or bottle. Beverage holders are frequently customized to include graphics and/or text for the purpose of corporate marketing, promotional advertisement, or commemorating a special event. Customized graphics and text are commonly applied to the beverage holder using a screen-printing process, for example. Koozies used for promotional purposes have been lacking in development and improvement. A suitable solution is desired.

U.S. Pub. No. 2013/0020223 to White relates to an insulated beverage holder. The described insulated beverage holder is a thermally insulating beverage holder that is easily customizable to include graphics, text, and/or photographs. The beverage holder comprises a lid, a base, a spine piece, and sleeve. The lid and base elements may be removably joined by the spine piece which holds the two elements in place and provides the proper spacing. The ends of the sleeve may be inserted into slots on either side of the spine piece with the lid and base fitting over the top and bottom edges of the sleeve, respectively. When the lid, base, spine piece, and sleeve are assembled, they define an interior cavity where a beverage container may be inserted.

SUMMARY OF THE INVENTION

In view of the foregoing disadvantages inherent in the known beverage container sleeve art, the present disclosure provides a novel insulated beverage container sleeve. The general purpose of the present disclosure, which will be described subsequently in greater detail, is to provide an insulated beverage container sleeve.

An insulated beverage container sleeve is disclosed herein. The insulated beverage container sleeve includes an insulated sleeve having a generally cylindrical profile. The insulated sleeve is configured to receive and host a beverage container within an inner volume. The insulated sleeve comprises a sidewall, an open top end, at least one flexible display screen, and a base. The at least one flexible display screen may be an LCD monitor configured to illuminate and display functional indicia. The insulated beverage container sleeve may bear specific visual designs and themes. The base houses a battery power source housed in communication with the flexible display screen. The base further includes a charging port, a power button, a central programming chip, and a battery life indication light. The insulated sleeve comprises a thermally insulating material for maintaining a temperature of a beverage contained within a hosted the beverage container and effectively ensures the beverage remains at a desired serving temperature.

A method of use may be as follows: a user may choose a desired design and style of the insulated beverage container sleeve and then ensure that the battery power source is charged. The user may then bring the insulated beverage container sleeve to a social environment of choice. A beverage container may be inserted within the insulated sleeve, where it will immediately receive insulation that helps a beverage contained within the beverage container retain a proper and desirable serving temperature. The user can then simply turn on the insulated beverage container sleeve via a power button.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an insulated beverage container sleeve, constructed and operative according to the teachings of the present disclosure.

The various embodiments of the present invention will hereinafter be described in conjunction with the appended drawings, wherein like designations denote like elements.

DETAILED DESCRIPTION

Figure 1:
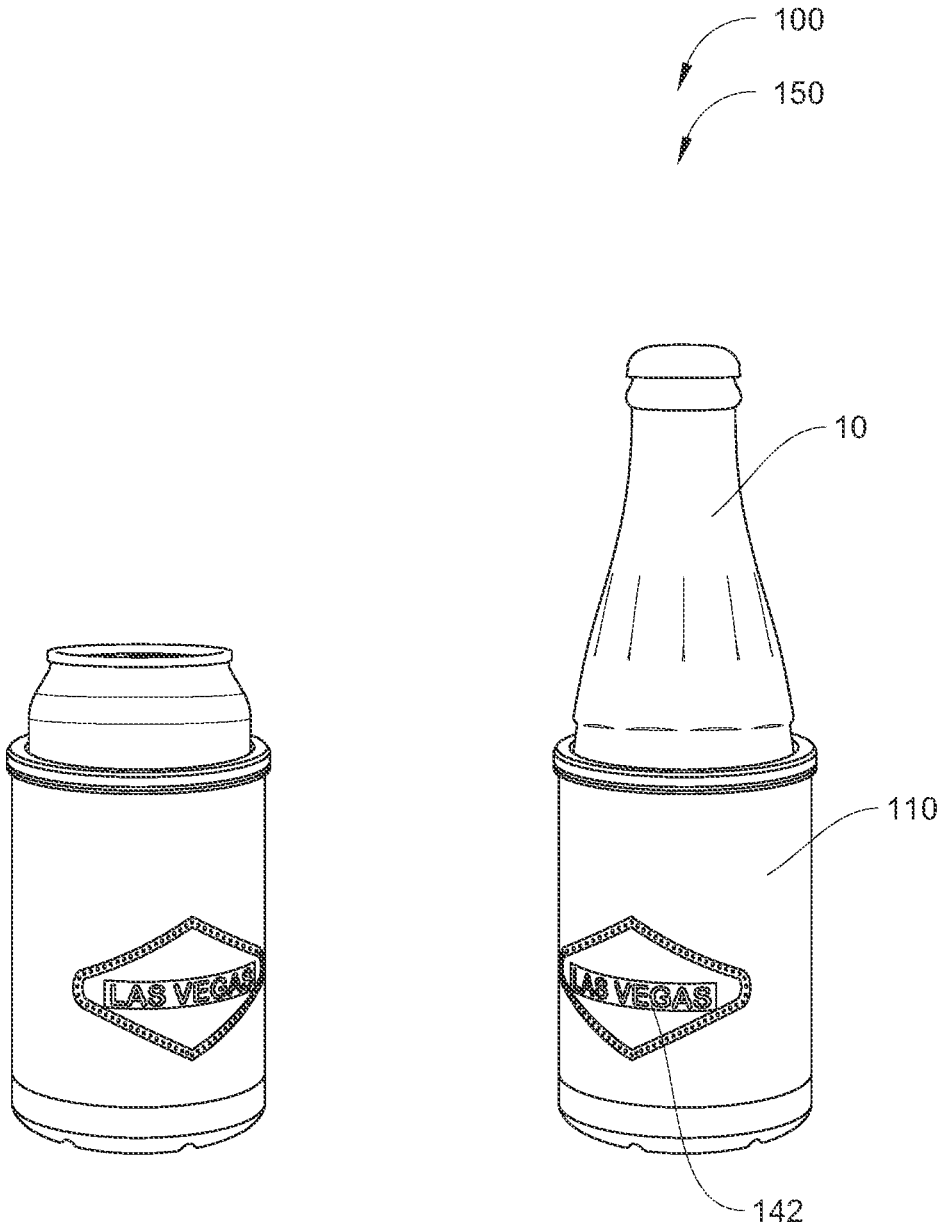
FIG. 1 is a perspective view of the insulated beverage container sleeve during an 'in-use' condition, according to an embodiment of the disclosure.

As discussed above, embodiments of the present disclosure relate to a beverage container sleeve and more particularly to an insulated beverage container sleeve as used to improve means for insulating beverage containers to display an illuminated image and/or message.

Generally, the insulated beverage container sleeve is an insulated sleeve for hosting various types of beverage containers and maintaining a temperature of a beverage contained within the beverage container. The insulated sleeve includes a display screen of liquid crystal display format (hereinafter referred to as "LCD") and light-emitting diodes ("LED") configured to display an illuminated image and/or message thereon. The insulated sleeve comprises a cylindrical profile and is configured to removably host a beverage container such as a bottle or can. The insulated sleeve is comprised of a thermally insulating material for maintaining a temperature of a beverage. The insulating material is coated with a thin sheet of PVC to protect electronics from moisture, at least one flexible display screen is then applied to the sidewall of the insulated sleeve, and a film is applied over the at least one flexible display screen to protect it. LEDs are then applied around the at least one flexible display screen. Any additional printed information can be applied to the body of the device, and the device then features a clear, durable plastic coating/sleeve on its exterior. This exterior sleeve features apertures to allow the screen and LEDs to broadcast through. The insulated sleeve further includes a moisture resistant top ring lining the insulating material and a ridged, moisture-resistant base. The exterior bottom of the base features water diverting channels to prevent water/moisture/condensation from pooling, and the base bottom also features a textured, anti-slip coating.

The insulated sleeve further includes a battery power source, a central programming chip, and operational components within the interior of the base. A USB charging port for charging and powering the device is accessible on the exterior sidewall of the base. A power button and battery life indicator are also on the sidewall of the base. The insulated sleeve may have options to tailor the image and message on the display screen to depict support of a specific team, event, holiday, birthday, or any special occasion. Additional, input for display may be uploaded via thumb drive using the USB port.

In a preferred embodiment, an interior sleeve of the insulated beverage container sleeve is made of neoprene in a cylindrical shape and with a closed, distal end. In size to host twelve-ounce beverage containers, the insulated beverage container sleeve measures approximately four and three-quarters of an inch in length by two and six-tenths of an inch in diameter (4¾"×2⁶⁄₁₀"). Coating the complete exterior plane of the interior sleeve is a moisture-proof sleeve of flexible polyvinyl chloride (PVC). The insulated beverage container sleeve may be made in various sizes to accommodate use with containers of twelve, sixteen, and twenty-four fluid ounce sizes (12, 16, and 24 fl oz).

Applied upon a strategic location of the exterior plane of the aforementioned coating is at least one flexible display screen, measuring approximately three inches in length by one inch in height (3"×1") when flat. The at least one flexible display screen may include an LCD monitor. In other strategic positions and in complimentary layout are LED lights, which apply individually to the PVC-coated sleeve. A final cylindrical sleeve, made of durable PVC, encases the collared, light-hosting sleeve. The final sleeve includes apertures that align with the LCD monitor and LEDs, allowing their external broadcast and exposure. These attached sleeves permanently mount upon a base, made of durable PVC. Within the base is a central programming chip, which includes programming for intended display, upon the at least one flexible display screen and the LED lights. The central programming chip connects by wire to the at least one flexible display screen and the LED lights.

The insulated beverage container sleeve ensures the user gets attention from others in the environment of use. The insulated beverage container sleeve allows the user to project an image and/or message to others from a distance, even before direct interaction with other people. The insulated beverage container sleeve can be a notable promotional tool for various products, places, and services.

A battery power source of rechargeable format connects to a central programming chip. A charging port connects to the battery power source and accepts an included charger cord for battery recharging. A power button is featured near the aforementioned port as is a battery life indication light. The bottom of the base features anti-slip coating on its flat surfaces. The base also features moisture-diverting channels.

As a primary non-limiting example, the insulated beverage container sleeve may be made in a format that displays the notable and well-recognized "Welcome to Fabulous Las Vegas" sign, and in which the "Welcome to Fabulous" portion is printed on an exterior plane of the insulated sleeve, the "Las Vegas" appears on a rectangular format of the LCD monitor, and the surrounding diamond shape of that sign appears in sequentially-activated LEDs.

In a secondary non-limited example, the insulated beverage container sleeve may be made in a format in which a football helmet is printed on the exterior plane of the insulating sleeve, the team logo may be printed in that helmet area, and the team name appears on a rectangular format of the LCD monitor.

In a tertiary non-limited example, the insulated beverage container sleeve can be made in format which has holiday images printed on the exterior plane of the insulating sleeve, an LCD monitor of square shape that displays a sequence of changing holiday scenes, and decoratively-enhancing LEDs.

A method of use may be as follows: a user may choose a desired design and style of the insulated beverage container sleeve and then ensure that the battery power source is charged. The user may then bring the insulated beverage container sleeve to a social environment of choice. A beverage container may be inserted within the insulated sleeve, where it will immediately receive insulation that helps a beverage contained within the beverage container retain a proper and desirable serving temperature. The user can then simply turn on the insulated beverage container sleeve via a power button.

Referring now more specifically to the drawings by numerals of reference, there is shown in FIGS. 1-6, various views of an insulated beverage container sleeve 100.

FIG. 1 shows an insulated beverage container sleeve 100 during an 'in-use' condition 150, according to an embodiment of the present disclosure. As illustrated, the insulated beverage container sleeve 100 may include an insulated sleeve 110 having a generally cylindrical profile and being configured to receive and host a beverage container 10 within an inner volume. The insulated sleeve 110 comprises a sidewall 112, an open top end 114, at least one flexible display screen 116, and a base 120. The at least one flexible display screen 116 configured to illuminate and display functional indicia 142. The base 120 includes a battery power source 122 housed within the base 120 and in communication with the flexible display screen 116, a charging port 124, a power button 126, a central programming chip 128, and a battery life indication light 130.

Figure 2:
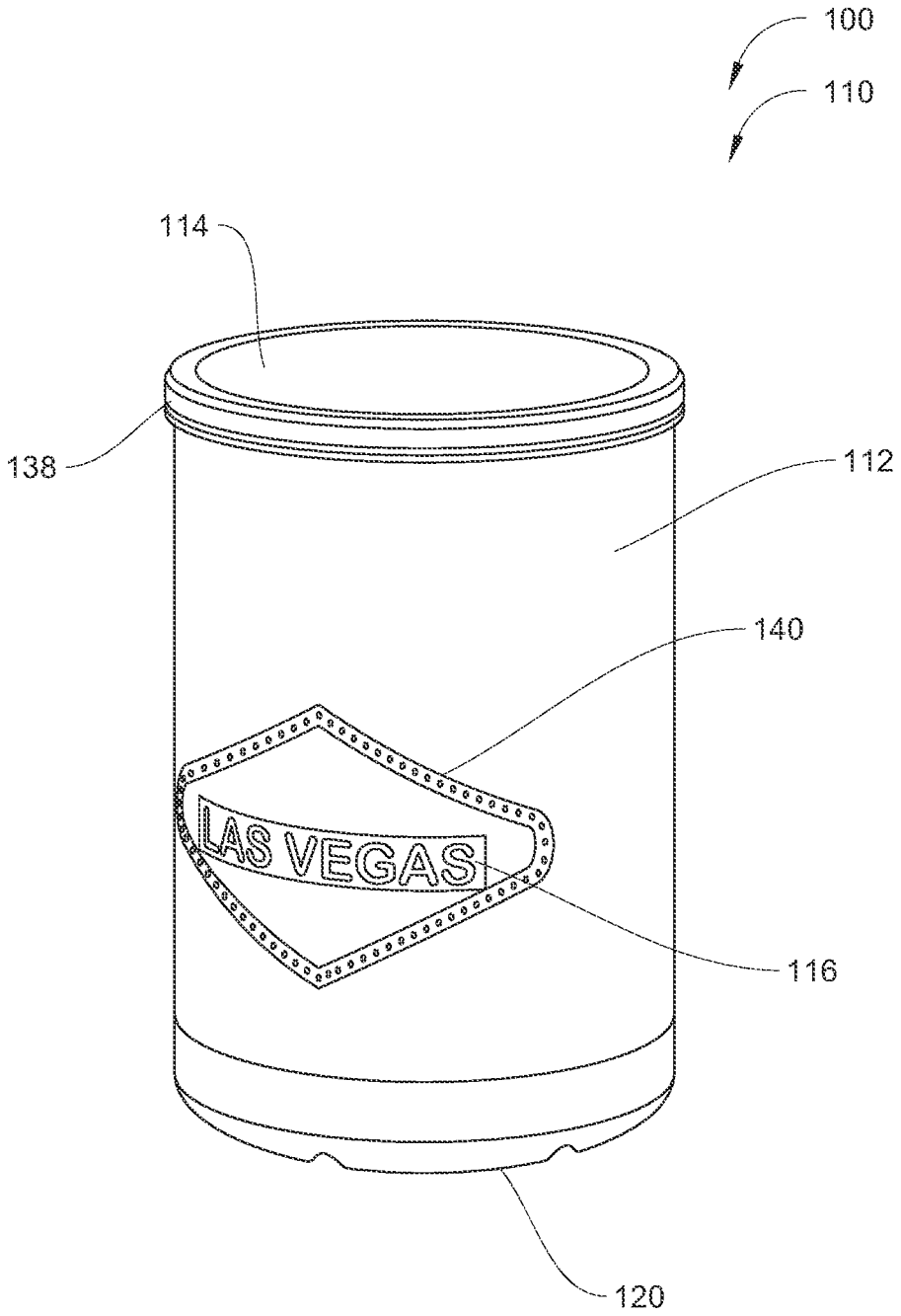
FIG. 2 is a perspective view of the insulated beverage container sleeve including an insulated sleeve having a sidewall, an open top end, and a base of FIG. 1, according to an embodiment of the present disclosure.
Figure 3:
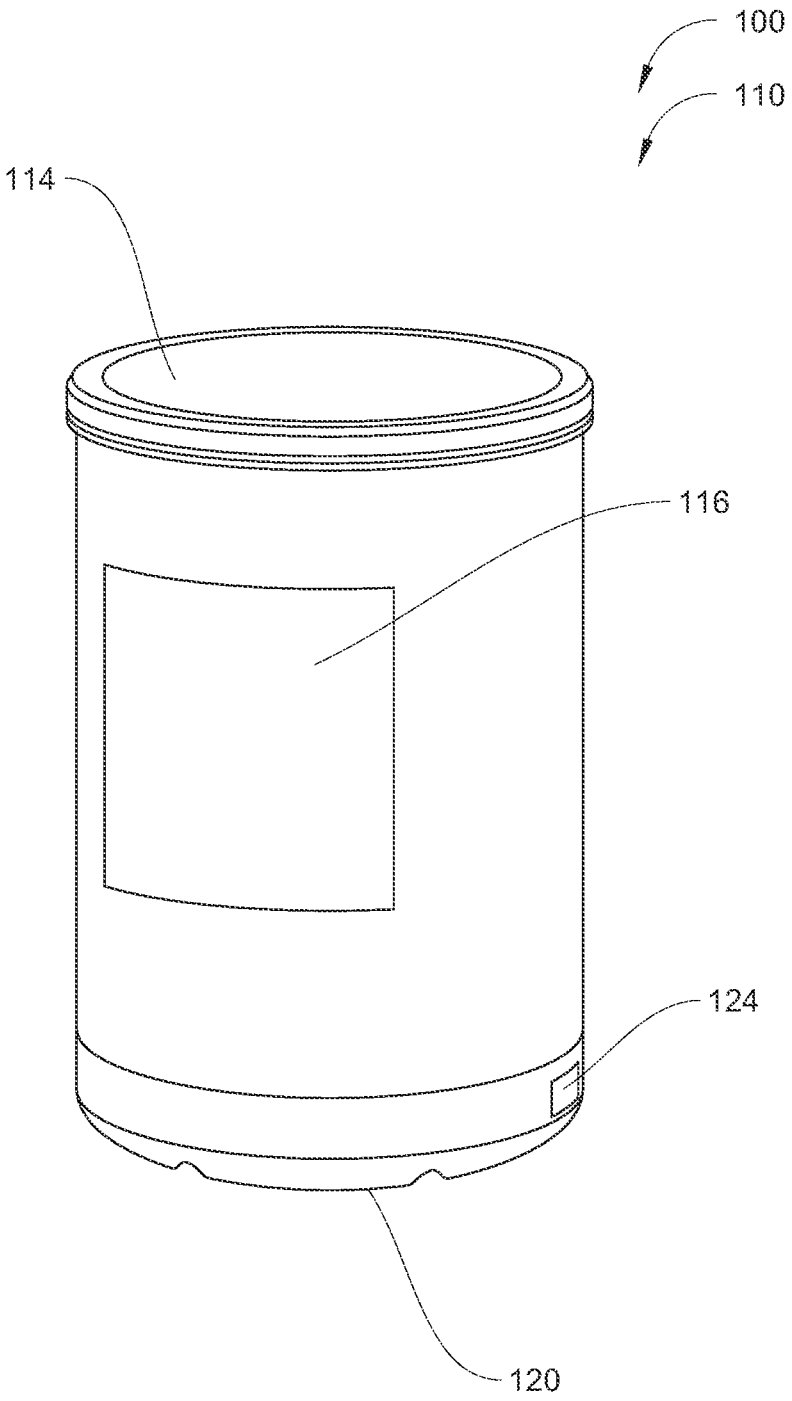
FIG. 3 is a perspective view of the insulated beverage container sleeve of FIG. 1, according to an embodiment of the present disclosure.

FIGS. 2-3 are perspective views of the insulated beverage container sleeve 100 of FIG. 1, according to an embodiment of the present disclosure. As above, the insulated beverage container sleeve 100 may include the insulated sleeve 110 comprising the sidewall 112, the open top end 114, the at least one flexible display screen 116, and the base 120. The insulated sleeve 110 comprises a thermally insulating material 132 for maintaining a temperature of a beverage contained within a hosted beverage container 10. The thermally insulating material 132 may be made of various different materials of applicability, including but not limited to neoprene and polyurethane (PU) foam. The thermally insulating material 132 of the insulated sleeve 110 is coated with a moisture-proof sleeve 134. The moisture-proof sleeve 134 comprises a sheet of flexible polyvinyl chloride or may be made of various different materials of applicability, such as but not limited to vinyl and polyethylene (PE). The at least one flexible display screen 116 is applied to the insulated sleeve 110 on top of the moisture-proof sleeve 134. The at least one flexible display screen 116 is a liquid crystal display screen. An additional film 136 is applied over the at least one flexible display screen 116. The additional film 136 is translucent and may be made of various colors. The insulated beverage container sleeve 100 may also be made in variations that have no film coating over the at least one flexible display screen 116. The insulated sleeve 110 further includes a moisture resistant top ring 138 at the open top end 114. The moisture resistant top ring 138 may be made of various materials included but not limited to PVC and DPE. In certain embodiments, the insulated sleeve 110 may not include the moisture resistant top ring 138.

The insulated sleeve 110 further comprises LED lights 140 positioned along the sidewall 112 which are configured to emit light. The LED lights 140 are applied to the moisture-proof sleeve 134 comprising the sheet of flexible polyvinyl chloride. The LED lights 140 and the at least one flexible display screen 116 are powered by the battery power source 122. The LED lights 140 and the at least one flexible display screen 116 forming an illuminated display of the insulated beverage container sleeve 100 ensures the insulated sleeve 110 can be easily seen even in dimly lit environments, such as picnics, tailgate gatherings, fairs, barbeques, and other such events. The LEDs of the insulated beverage container sleeve 100 may offer constant and/or sequential displays.

Figure 4:
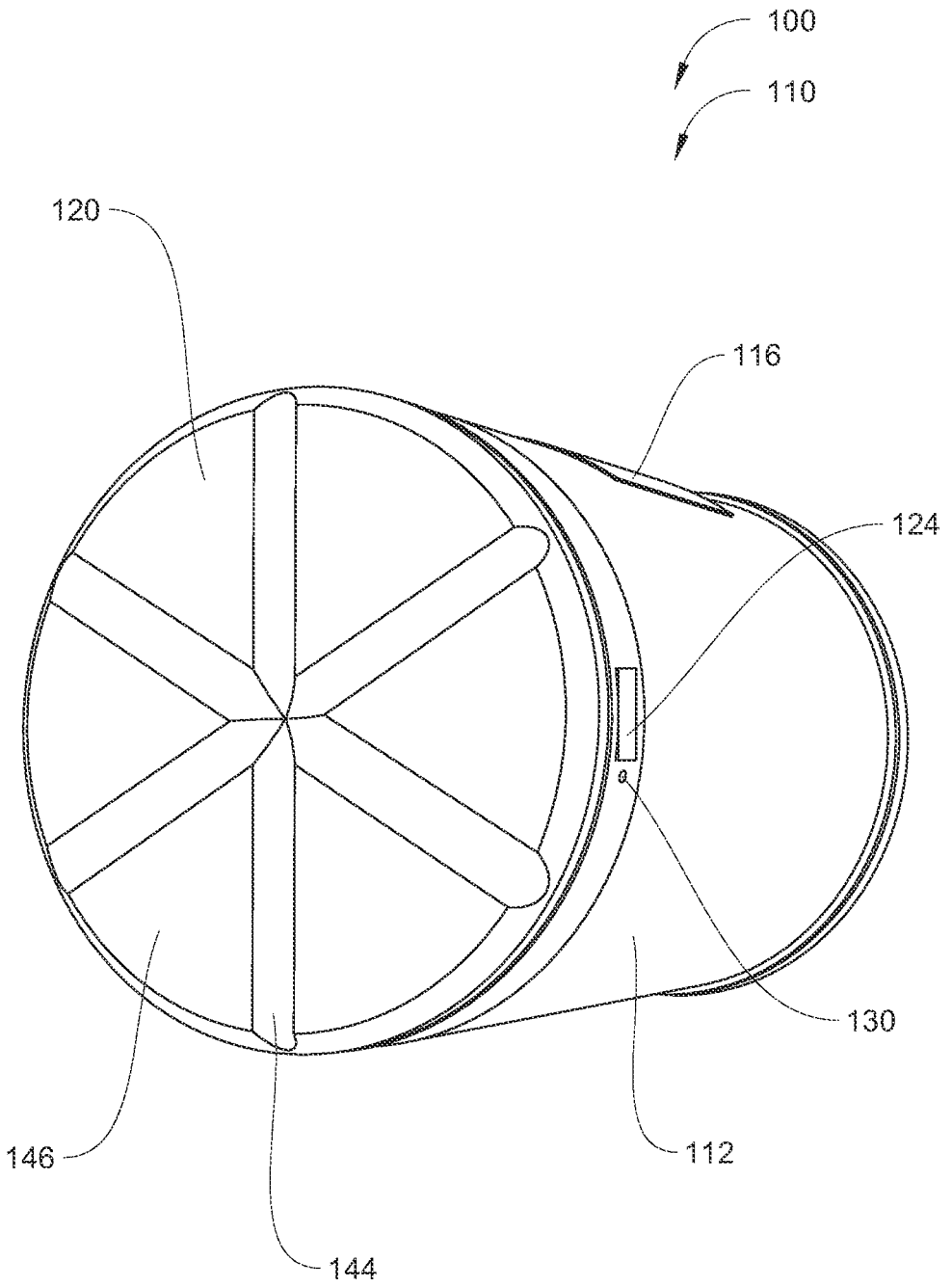
FIG. 4 is a bottom perspective view of the base of the insulated beverage container sleeve of FIG. 1, according to an embodiment of the present disclosure.

FIG. 4 is a bottom perspective view of the base 120 of the insulated beverage container sleeve 100 of FIG. 1, according to an embodiment of the present disclosure. As shown, the insulated sleeve 110 comprising the sidewall 112, the open top end 114, the at least one flexible display screen 116, and the base 120. The insulated sleeve 110 comprises a diameter of approximately two and six-tenths of an inch and a height of approximately four and three-quarters of an inch. The base 120 includes water diverting channels 144. The water diverting channels 144 divert water and prevent water, moisture, and condensation from accumulating around the insulated sleeve 110. This protects internal components including the battery power source 122 and a central programming chip 128 from possible contact with water, and prevents any liquid from pooling and causing a mess. In certain embodiments, the insulated sleeve 110 may not feature water diverting channels 144 on the base 120. The base 120 may further comprise a textured coating of anti-slip material 146 on the bottom plane of the base 120. The textured coating of anti-slip material 146 is provided to prevent the insulated sleeve 110 and a hosted beverage container 10 from slipping, falling, and spilling. In embodiments that do include water diverting channels 144, any number of water diverting channels 144 may be included and the water diverting channels 144 may take any shape.

Figure 5:
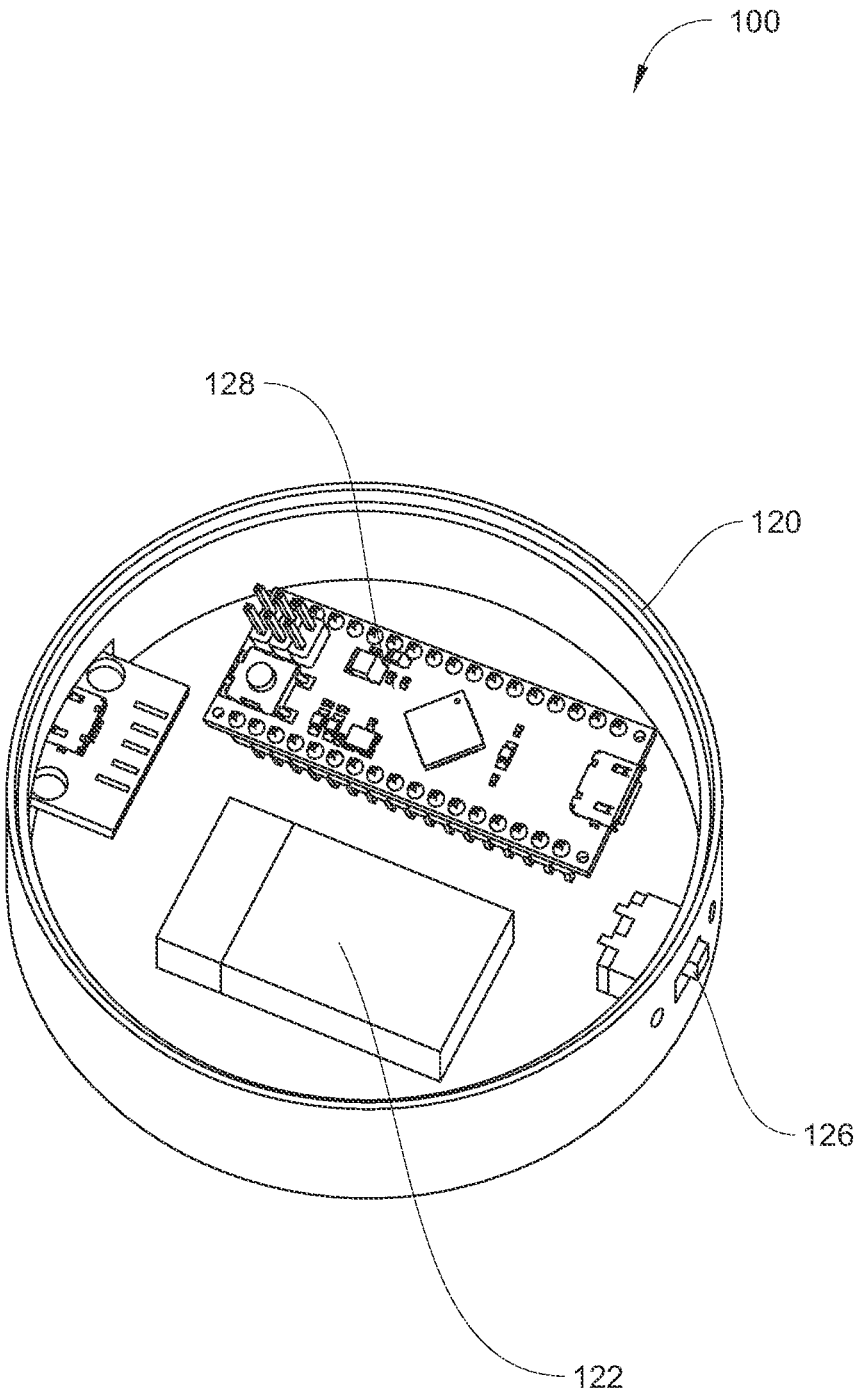
FIG. 5 is an internal view of the base of the insulated beverage container sleeve of FIG. 1, according to an embodiment of the present disclosure.

FIG. 5 is an internal view of the base 120 of the insulated beverage container sleeve 100 of FIG. 1, according to an embodiment of the present disclosure. As illustrated, the base 120 houses the battery power source 122 and a central programming chip 128. The battery power source 122 is preferably rechargeable. A charger cord may be provided for recharging the battery power source 122. Also featured on the base 120 the charging port 124 and the power button 126 for activation of the insulated beverage container sleeve 100. In a preferred embodiment, the charging port 124 includes a USB port. The central programming chip 128 may be programmable with intended functional indicia 142 to display on the at least one flexible display screen 116. The functional indicia 142 may include images and/or text. The insulated sleeve 110 is connectable to an external electronic device via the USB port for uploading and customizing the functional indicia 142 for displaying on the at least one flexible display screen 116.

Figure 6:
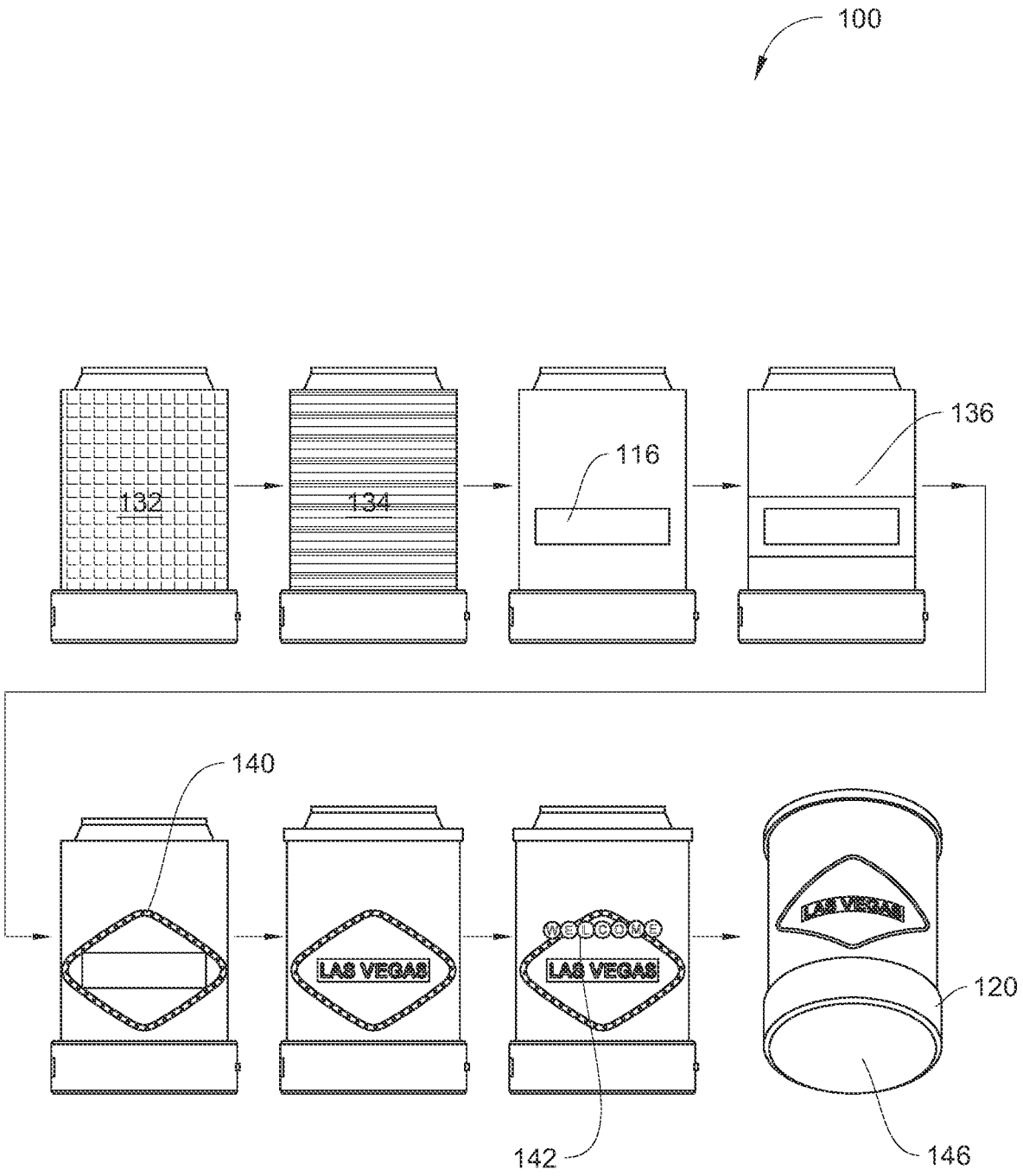
FIG. 6 is a diagram illustrating layers of the insulated beverage container sleeve of FIG. 1, according to an embodiment of the present disclosure.

FIG. 6 is a diagram illustrating layers of the insulated beverage container sleeve 100 of FIG. 1, according to an embodiment of the present disclosure. The insulated beverage container sleeve 100 includes various layers. The insulated sleeve 110 comprises a thermally insulating material 132 including but not limited to neoprene and polyurethane (PU) foam. The thermally insulating material 132 of the insulated sleeve 110 is coated with the moisture-proof sleeve 134. The moisture-proof sleeve 134 may include a sheet of flexible polyvinyl chloride or may be made of various different materials of applicability, such as but not limited to vinyl and polyethylene (PE). The at least one flexible display screen 116 and LED lights 140 are then applied to the insulated sleeve 110 on top of the moisture-proof sleeve 134. The additional film 136 is applied over the at least one flexible display screen 116 and the LED lights 140. The insulated beverage container sleeve 100 may also be made in variations that have no film coating over the at least one flexible display screen 116.

The insulated beverage container sleeve 100 can be produced in various designs and themes. The insulated beverage container sleeve 100 may be made in variations for use with various types of beverage containers 10, including but not limited to single-serve cans, single-serve bottles, pint glasses and party cups of various sizes and shapes. The insulated beverage container sleeve 100 may be made in specific promotional formats, such as but not limited to brand advertisement, event commemoration, and/or collegiate and professional team promotion.

The embodiments of the invention described herein are exemplary and numerous modifications, variations and rearrangements can be readily envisioned to achieve substantially equivalent results, all of which are intended to be embraced within the spirit and scope of the invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An insulated beverage container sleeve, the insulated beverage container sleeve comprises:

an insulated sleeve having a generally cylindrical profile and being configured to receive and host a beverage container within an inner volume, said insulated sleeve comprising, a sidewall, an open top end, at least one flexible display screen configured to illuminate and display functional indicia, a base including, a battery power source housed within said base and in communication with said flexible display screen, a charging port, a power button, a central programming chip, and a battery life indication light;

wherein said insulated sleeve comprises a thermally insulating material for maintaining a temperature of a beverage contained within a hosted said beverage container;

wherein said thermally insulating material of said insulated sleeve is coated with a moisture-proof sleeve;

wherein said moisture-proof sleeve comprises a sheet of flexible polyvinyl chloride;

wherein said at least one flexible display screen is applied to said insulated sleeve on top of said moisture-proof sleeve;

wherein said at least one flexible display screen is a liquid crystal display screen;

wherein an additional film is applied over said at least one flexible display screen;

wherein said insulated sleeve further includes a moisture resistant top ring at said open top end;

wherein said insulated sleeve further comprises LED lights positioned along said sidewall which are configured to emit light;

wherein said LED lights are applied to said moisture-proof sleeve comprising said sheet of flexible polyvinyl chloride;

wherein said LED lights and said at least one flexible display screen are powered by said battery power source;

wherein said battery power source is rechargeable;

wherein said central programming chip is programmable with intended said functional indicia to display on said at least one flexible display screen;

wherein said functional indicia includes images and text;

wherein said base comprises water diverting channels adjacent a bottom plane of said base;

wherein said base further comprises a textured coating of anti-slip material on said bottom plane of said base;

wherein said insulated sleeve comprises a diameter of approximately two and six-tenths of an inch and a height of approximately four and three-quarters of an inch;

wherein said charging port includes a USB port; and wherein said insulated sleeve is connectable to an external electronic device via said USB port for uploading and customizing said functional indicia for displaying on said at least one flexible display screen.

* * * * *